United States Patent [19]

Smith

[11] Patent Number: 4,573,887

[45] Date of Patent: Mar. 4, 1986

[54] CORROSION-RESISTANT ROLLER-TYPE PUMP

[75] Inventor: Jo Dee. J. Smith, Tustin, Calif.

[73] Assignee: S. E. Rykoff & Co., Los Angeles, Calif.

[21] Appl. No.: 532,671

[22] Filed: Sep. 16, 1983

[51] Int. Cl.[4] ..... F04B 43/12; F04B 45/08

[52] U.S. Cl. ..... 417/477

[58] Field of Search ..... 417/477, 476, 475

[56] References Cited

U.S. PATENT DOCUMENTS

| | | | |
|---|---|---|---|
| 3,756,752 | 9/1973 | Stenner | 417/477 |
| 4,070,725 | 1/1978 | Austin et al. | 417/477 X |
| 4,228,930 | 10/1980 | Hogan | 417/477 X |
| 4,229,299 | 10/1980 | Savitz et al. | 417/477 X |
| 4,315,718 | 2/1982 | Hogan | 417/477 |
| 4,432,707 | 2/1984 | Anderson et al. | 417/477 |

OTHER PUBLICATIONS

Chem-Feed Metering Pumps, Blue White Industries, 1982.

*Primary Examiner*—Richard E. Gluck
*Attorney, Agent, or Firm*—Charles E. Wills

[57] ABSTRACT

A roller-type pump for corrosive fluids such as detergents. The pump has a soft internal tube squeezed by rollers to provide the pumping action, and stiff kink-resistant outside conduits conveying fluid to and from the pump. Assembly of the pump's cover with its housing produces a fluid and air-tight connection between the tube and conduits. The pumping rollers are mounted on a spindle made of two identical parts which can be easily assembled and disassembled without tools or fasteners for cleaning, and installed in either direction for ease of maintenance and uniform wear. There are no metallic parts in the pump chamber, and the cover is transparent to allow observation and leak detection during operation.

7 Claims, 4 Drawing Figures

CORROSION-RESISTANT ROLLER-TYPE PUMP

BACKGROUND AND BRIEF SUMMARY OF THE INVENTION

Although peristalic or roller-type fluid pumps have been known for many years, they have found limited application in industry because of various deficiencies, including corrosion and maintenance problems.

In accordance with the present invention, a simple, rugged and reliable industrial-type, self-priming, roller-type pump is provided, which can transport measured amounts of caustic liquid to commercial dishwashers and commercial laundry equipment. This is accomplished by providing an assembly of non-metallic parts; a positive fluid and air-type clamping system at the inlet and outlet of the pump; a rotor assembly which is easy to assemble and dissassemble, and which cannot be improperly installed; and by providing a transparent cover which permits inspection and observation of the pumping mechanism during operation.

Thus, it is an object of the present invention to provide a self-priming, roller-type fluid pump whose pumping mechanism is made entirely of nonmetallic parts; which includes a roller assembly which is symmetrical and is easily assembled and dissassembled by unskilled personnel; and which is automatically sealed at the intake and output conduits when assembled.

It is a further object of the invention to provide a pump of the type described in which the operation of the rotor assembly or pumping mechanism can be continuously visually monitored.

Another object is to provide for manual rotation of the rotor assembly for inspection purposes.

The foregoing and other objects of the inventions will be fully understood from the following detailed description of one typical embodiment of the invention, throughout which description reference is made to the accompanying drawings.

DETAILED DESCRIPTION OF THE INVENTION

Figure 1:
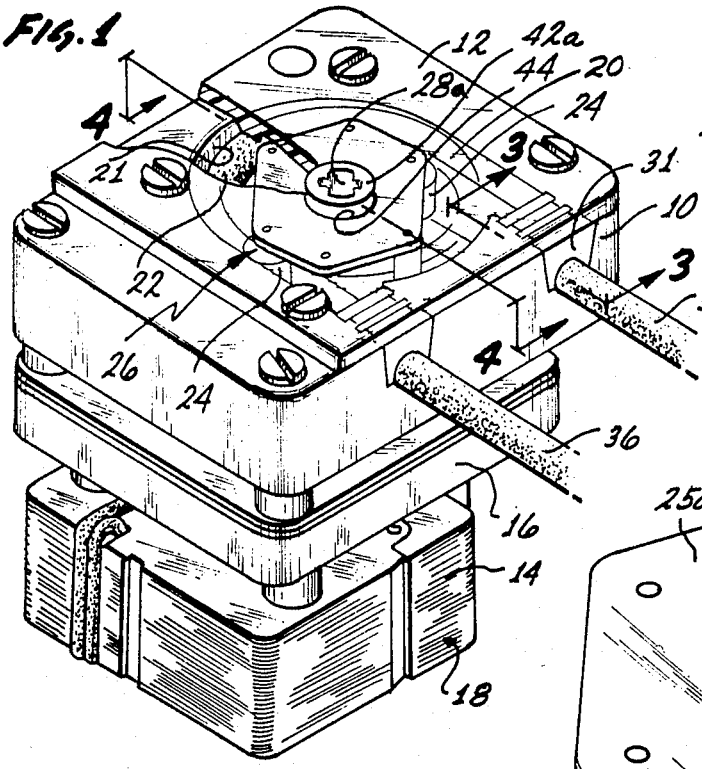
FIG. 1 is a perspective view, partially cut-away, of a pump constructed in accordance with the teachings of the present invention.

Referring to the drawings by reference numerals, and more particularly to FIG. 1 of the drawings, the pump of this invention includes a housing 10 with a transparent cover 12, mounted onto a conventional motor assembly 18. The motor assembly 18 includes a motor 14 and a gear reduction mechanism 16 whose output is a drive shaft (not shown) of any appropriate non-circular cross-section.

The housing 10, which is preferably made of a plastic material such as acetal, has formed in the upper portion thereof a generally circular chamber 20 with an inner wall 21, along which wall lies a tube 22 of a soft, easily deformable plastic material, preferably silicon.

At intervals of preferably 180°, tube 22 is squeezed against the inner wall 21 of chamber 20 by rollers 24 which are rotatably mounted on the spindle 25 of a rotor 26. The rollers 24 are preferably made of a self-lubricating plastic material such as acetal, and squeeze the tube 22 sufficiently tightly to obstruct it completely so that no back flow of fluid within the tube 22 can occur in the direction opposite to the direction of movement of the rotor 26.

Figure 2:
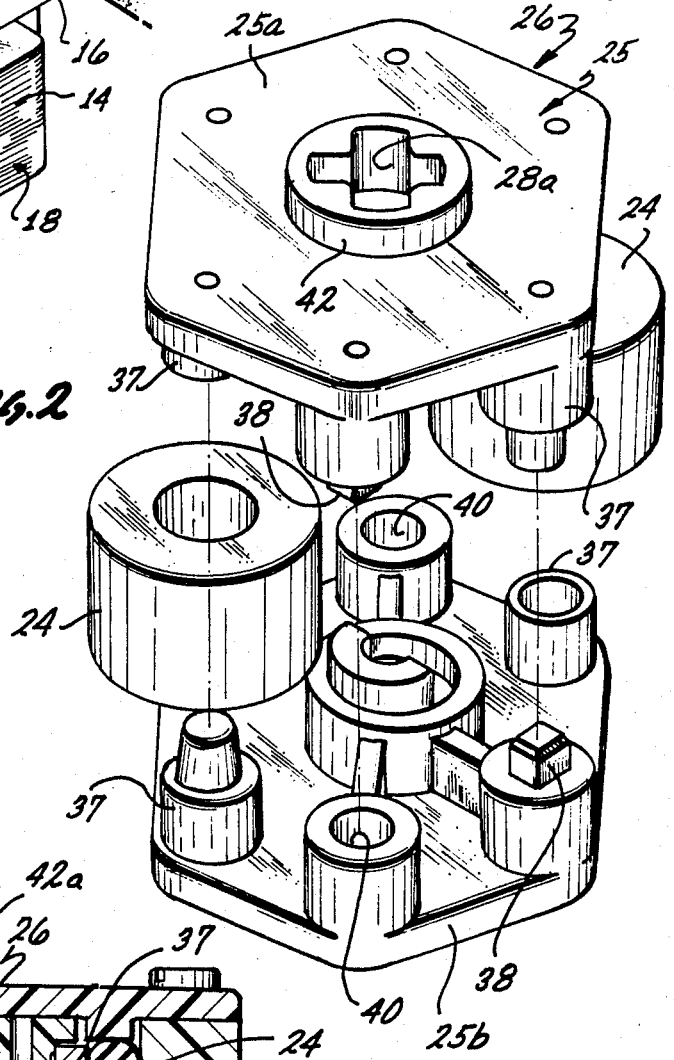
FIG. 2 is an enlarged, exploded perspective view of the rotor assembly.
Figure 4:
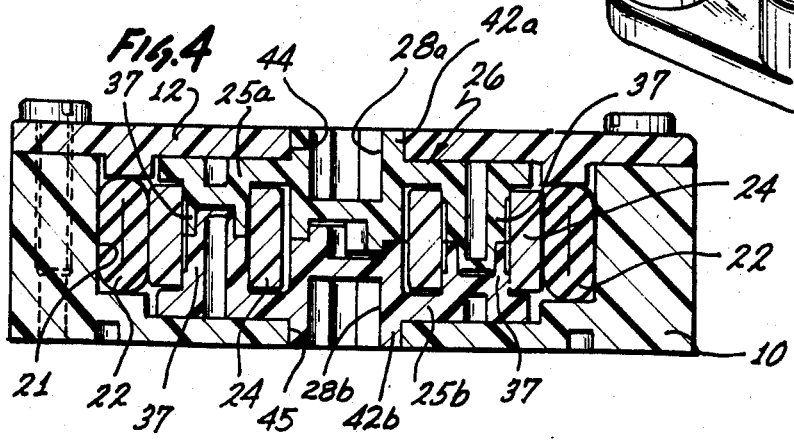
FIG. 4 is a vertical sectional view taken as indicated by the line 4—4 in FIG. 1.

The rotor 26 is driven by the drive shaft of the motor assembly 18, which shaft projects into the housing 10 and engages an appropriately-shaped receptacle **28*b* on the underside of the rotor 26. This receptacle is shown in FIG. 4 of the drawings, and is identical to the receptacle 28*a* on the upper side of the rotor assembly 26 shown in FIG. 2**.

The operation of the rotor assembly 26 within the chamber 20 can be continuously monitored through a transparent cover 12, which is preferably made of a hard, scratch-resistant plastic material such as polycarbonate.

Because the tube 22 is always engaged by at least one of the rollers 24, the pump is self-priming so long as no air enters the fluid line upstream of the rotor assembly. An airtight clamping arrangement for this purpose is described below.

Figure 3:
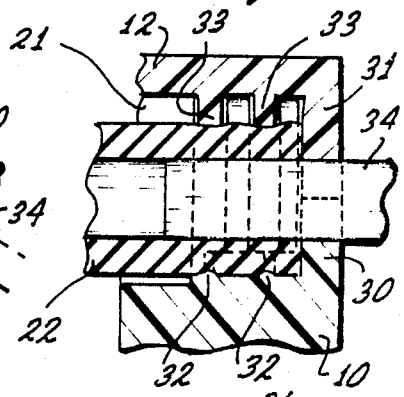
FIG. 3 is an enlarged, fragmentary, vertical sectional view taken as indicated by line 3—3 in FIG. 1.

The tube 22 is of a length such that its two ends engage, respectively, the inner surfaces of shoulder portions 30 and 31 (FIG. 3) formed, respectively, on the housing 10 and cover 12. Thus, the shoulders 30 and 31 hold the tube 22 in place in the chamber 20, so that the tube 22 is easy to position in the chamber 20 and is prevented from moving (or being pushed out of the housing 10) while the rollers 24 move along it and cause the fluid to be transported through it.

In order to prevent a malfunction of the pump, as could be caused by the kinking of conduits 34 and 36 through which fluid is conveyed to and from the pump, it is necessary to fabricate these conduits out of a relatively rigid material such as polypropylene.

To provide a fluid and air-tight connection between the semi-rigid conduits 35 and 36 and the easily deformable tube 22 at the entrance and exit of the pump housing, a second pair of shoulders 32 and 33 are formed inwardly of the shoulders 30 and 31 on the housing 10 and the cover 12, respectively. Thus, the shoulders 32 and 33 define between them an opening of a diameter slightly smaller than the outer diameter of the tube 22. Accordingly, when the ends of the conduits 34 and 36 are inserted into the ends of the tube 22 and the cover 12 is firmly mounted on the housing 10, as by screws, the shoulders 32 and 33 compress the tube 22 into tightly sealing contact with the conduits 34 and 36. It will be understood that the outer diameter of the conduits 34 and 36 is so chosen as to be approximately equal to the inner diameter of the tube 22.

To significantly reduce the cost of the pump and to prevent mistakes in assembly and maintenance, the spindle 25 of the rotor assembly 26 is preferably formed of two identical parts **25*a* and 25*b* (FIG. 2), which provide, inter alia, the bearings 37 for the rollers 24. The spindle 25 is preferably made of hard nylon to minimize wear and to provide a good bearing surface for the rollers 24**.

To provide for the assembly of the rotor 26 without any metallic fasteners, square-shaped pegs 38 are provided on each of the parts **25*a* and 25*b* to mate in a press-fit relationship with corresponding cylindrical sockets 40** on the other part.

This construction provides for quick and easy assembly and disassembly of the rotor assembly 26 for cleaning, if necessary. Also, because of the symmetrical configuration of parts 25*a* and 25*b*, the rotor can be reassembled into the pump in either position, i.e. with either part 25*a* or part 25*b* facing upwardly. Because of the shoulder construction and rotor arrangement described above, the pump of this invention is automatically properly assembled and leak-proofed when the cover 12 is tightly screwed onto the housing 10.

The outer faces of the parts 25*a* and 25*b* are provided with centrally located, raised circular bosses 42*a* and 42*b* (FIG. 4), which contain the receptacles 28*a* and 28*b*, respectively.

Correspondingly, the cover 12 contains a circular opening 44 of substantially the same diameter as the boss 42*a* and receives said boss in rotating supporting engagement when the cover is screwed onto the housing, and a similar circular opening 45 is provided in the bottom portion of the housing 10 to receive the boss 42*b*. Accordingly, the rotor assembly 26 and rollers 24 are maintained in a central position in the chamber 20 during the operation of the pump.

A further advantage of this construction is that either the receptacle 28*a* or 28*b* is exposed, whereby a tool such as a screwdriver can be inserted in it to manually rotate the rotor assembly 26 in the event of a malfunction, and for inspection purposes.

Thus, it will be readily apparent that the present invention provides an inexpensive yet rugged, easily maintainable and effective pump mechanism which is particularly suitable for use in industrial environments where it is necessary to pump measured amounts of corrosive liquids such as detergents.

Having described only one typical preferred embodiment of the invention, I do not wish to be limited to the specific details herein set forth but wish to reserve to myself and my assignee, any modifications and/or variations which might appear to those skilled in the art, and which fall within the scope of the following claims.

I claim:

1. A rotary pump for pumping measured amounts of corrosive fluids, comprising:

a housing containing a chamber having a curved inner wall;

a removable cover with an outer sursface for closing the chamber;

power-driven rotor means within said housing;

a soft resilient tube with two ends, disposed within the chamber along said inner wall, said tube being squeezed closed by said rotor means against said inner wall at spaced intervals so as to transport predetermined quantities of fluid along said tube as said rotor means turns;

relatively stiff, kink-resistent conduit means engaging the ends of said tube for conveying fluid into and out of said tube; and clamping means forming a releasable fluid-type bond between the ends of said tube and said conduit means;

said rotor means containing opposed outer surfaces, each of which surfaces is provided with a like, outwardly extending annular boss with an outer surface; and said cover containing a circular opening for rotatably receiving one of said bosses when the cover is in closed relationship with the housing, with the outer surface of the boss being in a generally planar relationship with the outer surface of the cover.

2. The pump of claim 1, in which the housing contains a like circular opening for rotatably receiving the other of said bosses, with the outer surface of the boss being in a generally planar relationship with the outer surface of the housing, whereby said rotor means is rotatably supported in a predetermined position in the housing.

3. The pump of claim 2, in which each boss contains a receptacle in the outer face thereof for receiving a drive shaft or a tool for selectively turning the rotor means.

4. A rotary pump for pumping measured amounts of corrosive fluids, comprising:

a housing containing an upwardly opening chamber having a curved inner wall;

a cover for closing the chamber;

power-driven rotor means within said housing;

a soft resilient tube with two ends, disposed within the chamber along said inner wall, said tube being squeezed closed by said rotor means against said inner wall at spaced intervals so as to transport predetermined quantities of fluid along said tube as said rotor means turns;

rollers mounted on said rotor means and rollingly engaging said tube, at least one of said rollers being in squeezing contact with said tube at all times so as to make said pump self-priming;

said rotor means including spindle means formed of a pair of identical parts rotatably holding said rollers between them, each of said identical parts including integral peg means forming a press fit with corresponding integral sockets of the other part to releasably hold said parts together;

said rotor means further containing upper and lower surfaces, each of which surfaces is provided with a like, outwardly extending annular boss, and the cover contains a circular opening for rotatably receiving one of said bosses when the cover is in closed relationship with the housing, and the housing contains a like circular opening for rotatably receiving the other of said bosses whereby said rotor means is rotatably supported in a predetermined position within the housing;

relatively stiff, kink-resistant conduit means engaging the ends of said tube for conveying fluid into and out of said tube; and clamping means formed integral with the housing and the cover for forming a releasable fluid-tight bond between the ends of said tube and said conduit means.

5. A rotary pump for pumping measured amounts of corrosive fluids, comprising:

a housing containing an upwardly opening chamber having a curved inner wall;

a cover for closing the chamber;

power-driven rotor means within said housing;

a soft resilient tube with two ends, disposed within the chamber along said inner wall, said tube being squeezed closed by said rotor means against said inner wall at spaced intervals so as to transport predetermined quantities of fluid along said tube as said rotor means turns;

rollers mounted on said rotor means and rollingly engaged said tube, at least one of said rollers being in squeezing contact with said tube at all times so as to make said pump self-priming;

said rotor means including spindle means formed of a pair of identical parts rotatably holding said rollers between them, each of said identical parts including integral peg means forming a press fit with corresponding integral sockets of the other part to releasably hold said parts together;

said rotor means further containing upper and lower surfaces, each of which surfaces is provided with a like, outwardly extending annular boss, and the cover contains a circular opening for rotatably receiving one of said bosses when the cover is in closed relationship with the housing, and the housing contains a like circular opening for rotatably receiving the other of said bosses whereby said rotor means is rotatably supported in a predetermined position within the housing; and relatively stiff, kink-resistant conduit means engaging the ends of said tube for conveying fluid into and out of said tube.

6. A rotary pump for pumping measured amounts of corrosive fluids, comprising:

a housing containing a chamber having a curved inner wall;

a power-driven rotor means within said housing;

a soft resilient tube with two ends, disposed within the chamber along said inner wall, said tube being squeezed closed by the rotor means against said inner wall at spaced intervals so as to transport predetermined quantities of fluid along said tube as said rotor means turns;

the squeezing of said tube being accomplished by rollers mounted on said rotor means and rollingly engaging said tube, at least one of said rollers being in squeezing contact with said tube at all times so as to make said pump self-priming;

said rotor means including spindle means formed of a pair of identical parts rotatably holding said rollers between them, each of said identical parts including integral peg means forming a press fit with corresponding integral sockets of the other part to releasably hold said parts together;

relatively stiff, kink-resistant conduit means engaging the ends of said tube for conveying fluid into and out of said tube; and means for forming a releasable fluid-tight bond between the ends of said tube and said conduit means.

7. The pump of claim 6, in which said peg means are square, and said sockets are cylindrical.

* * * * *